US006067710A

United States Patent [19]

Sakaoka et al.

[11] Patent Number: 6,067,710

[45] Date of Patent: May 30, 2000

[54] METHOD FOR MANUFACTURING A MEMORY CARD ELECTRICAL CONNECTOR WITH CONTACTS HAVING A GROUND TERMINAL

[75] Inventors: Masaki Sakaoka; Hirohisa Takano, both of Kanagawa-ken, Japan

[73] Assignee: Kyocera Elco Corporation, Kanagawa-ken, Japan

[21] Appl. No.: 09/123,506

[22] Filed: Jul. 28, 1998

[30] Foreign Application Priority Data

Jul. 31, 1997 [JP] Japan ..... 9-205906

[51] Int. Cl.[7] ..... H01R 9/00; H01R 11/00

[52] U.S. Cl. ..... 29/842; 29/884; 29/876

[58] Field of Search ..... 29/842, 884, 876, 29/881, 882, 874

[56] References Cited

U.S. PATENT DOCUMENTS

| | | | |
|---|---|---|---|
| 4,361,955 | 12/1982 | Lancaster | 29/844 |
| 4,891,014 | 1/1990 | Simpson et al. | 439/67 |
| 4,920,642 | 5/1990 | Yanai et al. | 29/860 |
| 4,996,766 | 3/1991 | Piorunneck et al. | 29/842 |
| 5,239,748 | 8/1993 | Hamilton | 29/843 |

*Primary Examiner*—Carl J. Arbes
*Assistant Examiner*—Bobby Rushing, Jr.
*Attorney, Agent, or Firm*—McCormick, Paulding & Huber LLP

[57] ABSTRACT

A memory card is comprised of a synthetic resin frame, a memory board housed in a frame, metal contacts for connecting conductor patterns of a memory board and external pins, a connector body formed from synthetic resin having a number of contact compartments in which the contacts are received, a metal cover plate which covers an opening of the frame in which the memory board and the connector body are housed, and a cut-away portion which is formed on at least one of the contact compartments of the connector body and which is opposed to the cover plate. A method for manufacturing contacts having a ground terminal for the memory card includes forming a pattern contact piece which comes into contact with one of the conductor patterns of the memory board, a pin contact piece which comes into contact with the external pin inserted from the outside, and a ground contact piece which projects from the cut-away portion to come into contact with the metal cover plate, on each of the contacts, and bending the ground contact piece when inserted in the corresponding contact compartment so as to project outward from the cut-away portion, and inserting the contacts in the corresponding contact compartments.

8 Claims, 6 Drawing Sheets

METHOD FOR MANUFACTURING A MEMORY CARD ELECTRICAL CONNECTOR WITH CONTACTS HAVING A GROUND TERMINAL

BACKGROUND OF THE INVENTION

1. Field of the Invention

The present invention relates to a contact having a ground terminal for a memory card and a method for manufacturing the same.

2. Description of the Related Art

In general, a memory card is comprised of a memory board having a memory function, such as an IC, which is housed in a frame, and a connector body provided on one side of the frame. The connector body is provided with a group of contacts soldered to a predetermined conductor pattern of the memory substrate. To prevent the memory from being corrupted due to static electricity, the frame is covered by a metal cover plate which is connected to a ground terminal of the memory substrate.

To establish an electrical connection between the metal cover plate and the ground terminal of the memory substrate, a metal spring is provided therebetween or the cover plate is equipped with a contact piece which is formed by cutting and raising a part of the cover plate and which is connected to the ground terminal. However, this increases the manufacturing cost or assembling cost of the elements or device.

SUMMARY OF THE INVENTION

It is an object of the present invention to provide a method for manufacturing contacts having a ground terminal for a memory card, wherein the metal cover plate can be easily connected to the ground terminal of the memory board by a simple structure and, thus the memory card can be easily produced.

The present invention has been completed based on the basic idea that one of a group of contacts mounted to the connector body is used as a ground contact through which the metal cover plate is electrically connected to the ground terminal of the memory board.

Namely, according to the present invention, there is provided a method for manufacturing contacts having a ground terminal for a memory card which is comprised of a synthetic resin frame, a memory board housed in the frame, metal contacts for connecting conductor patterns of the memory board and external pins, a connector body formed from synthetic resin having a number of contact compartments in which the contacts are received, a metal cover plate which covers an opening of the frame in which the memory board and the connector body are housed, and a cut-away portion which is formed on at least one of the contact compartments of the connector body and which is opposed to the cover plate, wherein the method comprises the steps of forming a pattern contact piece which comes into contact with one of the conductor patterns of the memory board, a pin contact piece which comes into contact with the external pin inserted from the outside, and a ground contact piece which projects from the cut-away portion to come into contact with the metal cover plate, on each of the contacts, and bending said ground contact piece when inserted in the corresponding contact compartment so as to project outward from the cut-away portion, and inserting the contacts in the corresponding contact compartments before the connector body is placed in the frame.

If the ground contact pieces of all of the contacts are flat before inserted in the contact compartments, an additional step can be included to bend the ground contact piece of the contact only that is inserted in the ground contact compartment due to the plastic deformation after the insertion is completed. Consequently, the ground contact piece can be brought into contact with the cover plate.

Preferably, the contact can be composed of a contact body and a ground contact terminal having a ground contact piece separate from the contact body. The contact body which is provided with the pattern contact piece which comes into contact with one of the conductor patterns of the memory board and the pin contact piece which comes into contact with the external pin inserted from the outside can be provided with a holding piece which is located within the cut-away portion when the contact is inserted in the contact compartment having the cut-away portion. The ground contact terminal can be provided with a mounting portion which can be mounted to the holding piece of the contact body which is inserted in the contact compartment having the cut-away portion and a ground contact piece which can be brought into contact with the cover plate.

The ground contact piece of the ground contact terminal is bent in advance to project from the cut-away portion to thereby come into contact with the cover plate, prior to the mounting to the contact body. Alternatively, it is possible to bend the ground contact piece outward due to the plastic deformation after it is mounted to the contact body, so that the ground contact piece projects from the cut-away portion so as to come into contact with the cover plate.

The contact or the contact body which is to be received in the contact compartment having the cut-away portion can be either identical to or different from in shape the remaining contacts or contact bodies. If the contacts are all identical to each other, the contacts can be produced by the same pressing dies, thus resulting in a reduced manufacturing cost or maintenance cost.

According to another aspect of the present invention, there is provided a contact having a ground terminal for a memory card which is comprised of a synthetic resin frame, a memory board housed in the frame, metal contacts for connecting conductor patterns of the memory board and external pins, a connector body formed from synthetic resin having a number of contact compartments in which the contacts are received, a metal cover plate which covers an opening of the frame in which the memory board and the connector body are housed, and a cut-away portion which is formed on at least one of the contact compartments of the connector body and which is opposed to the cover plate, comprising a contact body having a pattern contact piece which comes into contact with one of the conductor patterns of the memory board, a pin contact piece which comes into contact with the external pin inserted from the outside, and a holding piece which is located in the cut-away portion when inserted in the contact compartment having the cut-away portion, and a ground contact terminal separate from the contact body, having a mounting portion which can be mounted to the holding piece and a ground contact piece which can be brought into contact with the cover plate when mounted to the holding piece located within the cut-away portion.

The present disclosure relates to subject matter contained in Japanese Patent Application No. 9-205906 (filed on Jul. 31, 1997) which is expressly incorporated herein by reference in its entirety.

BRIEF DESCRIPTION OF THE DRAWINGS

The invention will be described below in detail with reference to the accompanying drawings, in which.

DESCRIPTION OF THE PREFERRED EMBODIMENT

Figure 1:
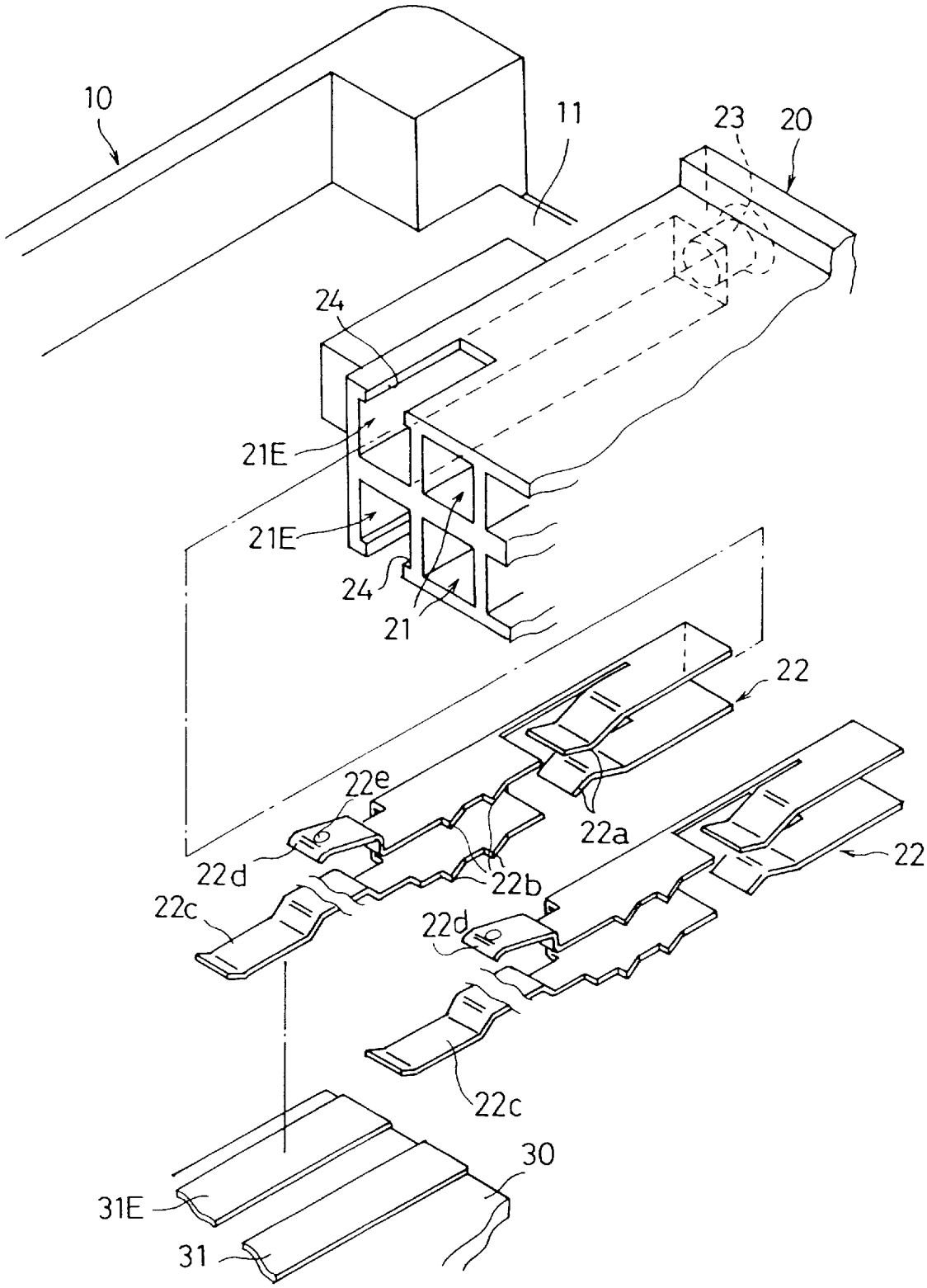
FIG. 1 is an exploded perspective view of a main part of a memory card according to the present invention.

A memory card to which the present invention is applied will be discussed below with reference to FIGS. 1 through 4, by way of example.

A synthetic resin frame (mold frame, plastic frame, casing) 10 has open upper and lower surfaces and is provided on its one side thereof with an opening 11 for receiving a connector body 20. The connector body 20 has two rows of upper and lower contact compartments 21 in which contacts 22 are inserted and secured. The connector body 20 is provided on its one end surface with terminal pin insertion holes 23 which open into the contact compartments 21. The other end surface of the connector body 20 opens to define a contact insertion opening.

Figure 2:
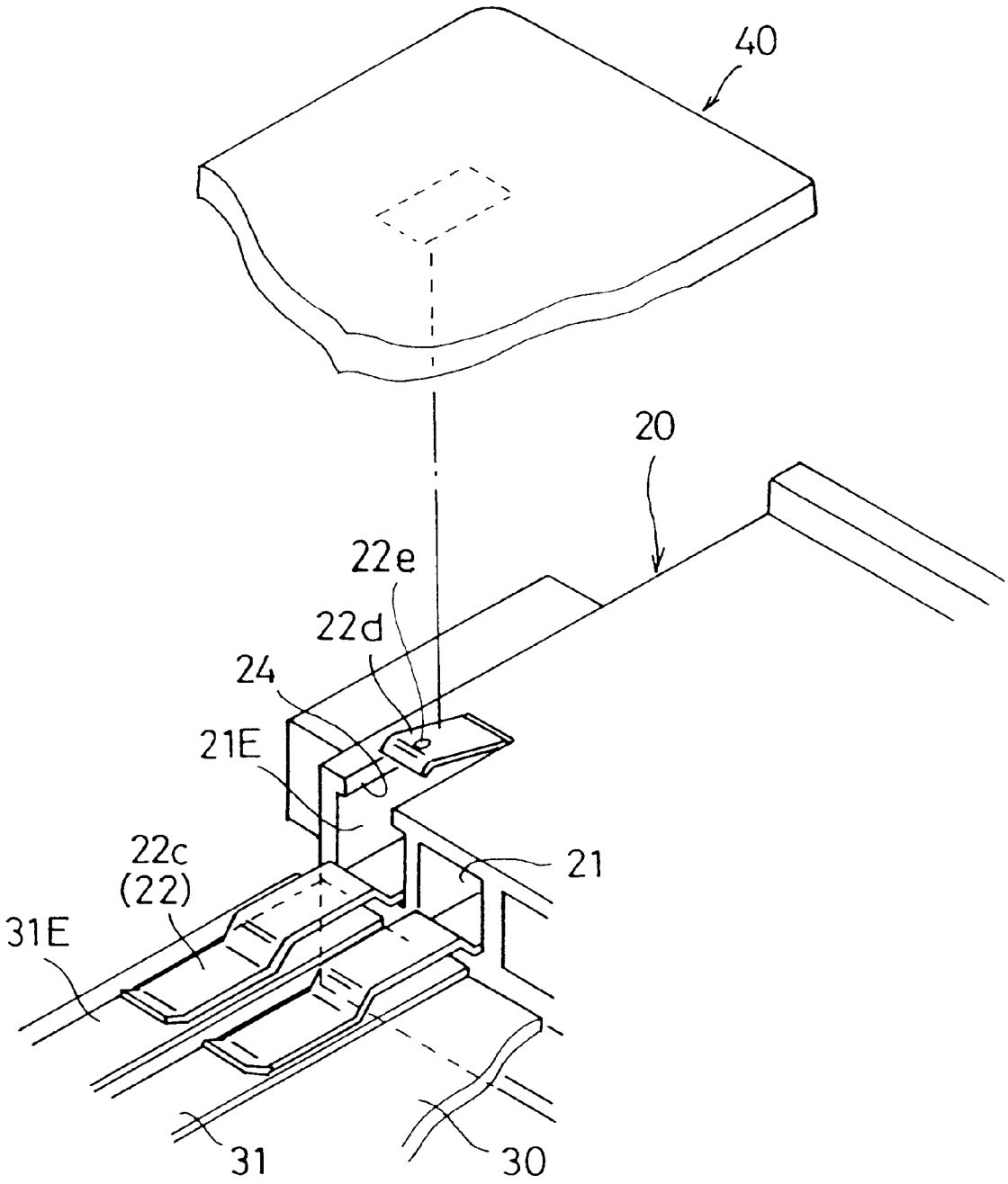
FIG. 2 is a perspective view of a ground contact and a cover plate, according to the present invention.
Figure 3:
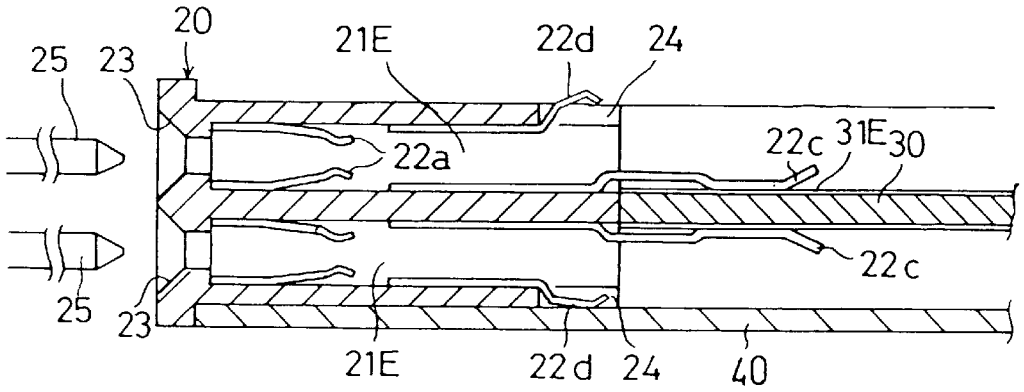
FIG. 3 is a longitudinal sectional view of FIG. 2.
Figure 4:
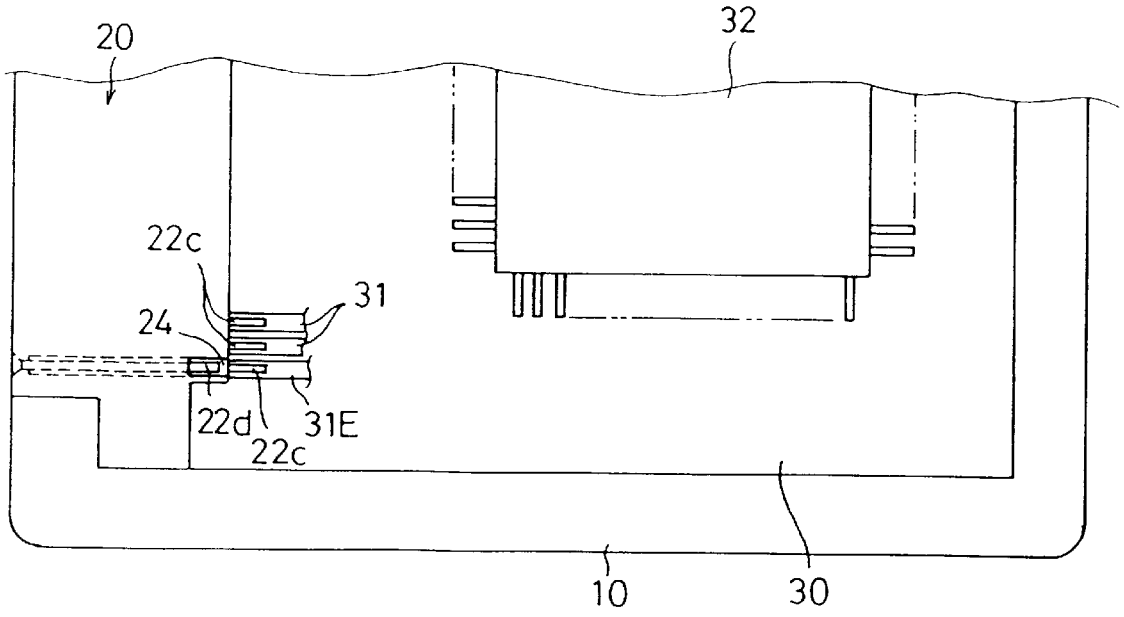
FIG. 4 is a plan view of a memory card with the cover plate removed.

Among the contact compartments 21, the upper left end and lower left end contact compartments 21E in FIG. 1 or 2 are ground contact compartments which are provided on the upper surface and the lower surface thereof, with cut-away portions (openings) 24, respectively. The remaining contact compartments 21 have no cut-away portion.

The contacts 22 are identical and are in the form of a general U-shape as viewed from the front elevation. Each contact 22 is provided, on the opposed (upper and lower) plate portions thereof, with pin contact pieces 22*a* which are bent toward each other so that the pin contact pieces 22*a* can be brought into contact with external contact pins 25 inserted through the terminal pin insertion holes 23, and securing projections 22*b* which protrude outward from the edges of the opposed plate portions and which engage with the inner surfaces of the contact compartments 21 to secure the contacts 22 at a predetermined position. Moreover, each contact 22 is provided, on one of the opposed plate portions, with a soldering tail (pattern contact piece) 22*c* which comes into contact with and is soldered to a conductor pattern 31 of the memory board 30, and on the other opposed plate portion, with a ground contact piece 22*d*. The ground contact piece 22*d* is provided on the outer surface thereof with a projection 22*e* that can be brought into contact with the cover plate 40. The projection 22*e* contributes to the stable contact of the ground contact piece 22*d* with the cover plate 40 and ensures that static electricity is discharged therethrough. In addition, the contact 22 can be formed of a metal plate such as a copper alloy plate including tin and phosphorus or a metal plate which can be elastically deformed, by a series of machining operations including shear pressing.

In the first embodiment, the ground contact piece 22*d* is bent in the machining operations so that it protrudes out of the ground contact compartment 21E through the cut-away portion 24 when the associated contact 22 is inserted in the ground contact compartment 21E having the cut-away portion 24. The ground contact piece 22*d* when inserted in the contact compartment 21 other than the ground contact compartment 21E is in press contact with the inner surface of the contact compartment 2 and does not protrude out of the contact compartment due to the absence of the cut-away portion 24.

The terminals 31 of the memory board 30 include ground terminals 31E corresponding to the ground contact compartments 21E and signal terminals connected to an IC 32, etc.

The connector body 20 is assembled as follows.

The contacts 22 are inserted in the ground contact compartments 21E of the connector body 20, with the ends of contacts adjacent to the pin contact pieces 22*a* being the leading ends. The contacts 22 are held in place by the abutment of the leading ends thereof against the inner wall surface of the ground contact compartments 21E and the engagement of the securing 22*d* with the inner wall surfaces of the ground contact compartments 21E. In this position, the ground contact pieces 22*d* project outward from the cut-away portions 24. Other contacts 22 are inserted in the remaining contact compartments 21.

When the contacts 22 are inserted in all of the contact compartments 21 and 21E of the contact body 20, the memory board 30 is inserted in a space defined between the two rows of soldering tails 22*c*. Consequently, the conductor patterns of the memory board 30 are brought into contact with and soldered to the corresponding soldering tails 22*c*. Thereafter, the connector body 20 and the memory board 30 are received in the frame 10 whose upper and lower open surfaces are then closed by the cover plate 40. Since the ground contact pieces 22*d* which project outward from the cut-away portions 24 of the connector body 20 come into contact with the cover plate 40, the ground terminal 31E of the memory board 30 is electrically connected to the cover plate 40 through the contacts 22.

Thus, the assembling operation of the connector having the ground terminals for the memory card is completed. In the illustrated embodiment, since the connection to the ground terminals and the signal terminals can be established by the identical contacts 22, not only can the number of the components can be reduced but also the manufacturing cost can be reduced and the assembling operation can be simplified.

In the first embodiment illustrated in FIGS. 1 through 4, the ground contact pieces 22*d* are bent in advance prior to the insertion of the contacts 22 into the ground contact compartments 21E. In the second embodiment which will be discussed below, the ground contact pieces 22*d* are bent after the contacts are inserted in the ground contact compartments 21E.

Figure 5:
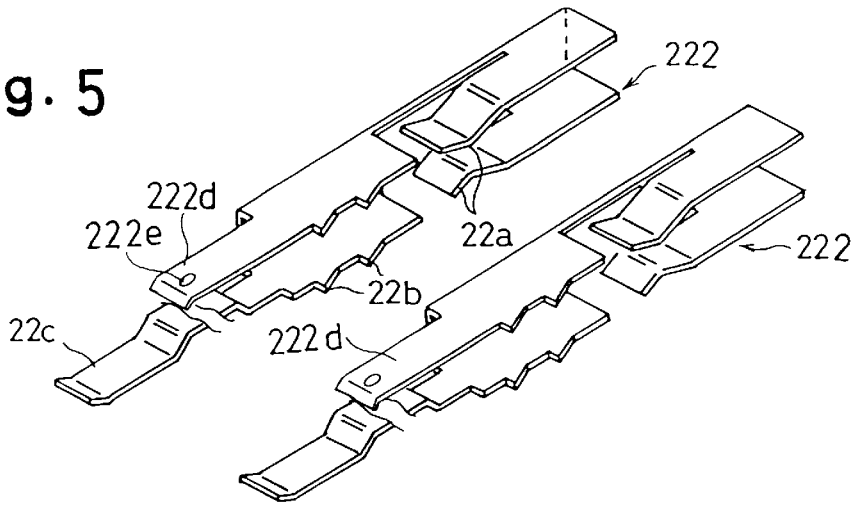
FIG. 5 is a perspective view of a second embodiment of contacts according to the present invention.

FIG. 5 shows a second embodiment of the contacts 222. In the second embodiment, the elements whose shape and function are same as those of the corresponding elements in the first embodiment are designated with like reference numerals and no duplicate explanation thereof will be given. The ground contact pieces 222*d* of the contacts 222 extend substantially linearly in the second embodiment. The mounting of the contacts 222 in the ground contact compartments 21E and the contact compartments 21 (manufacturing of the contacts) are carried out as follows.

Figure 6:
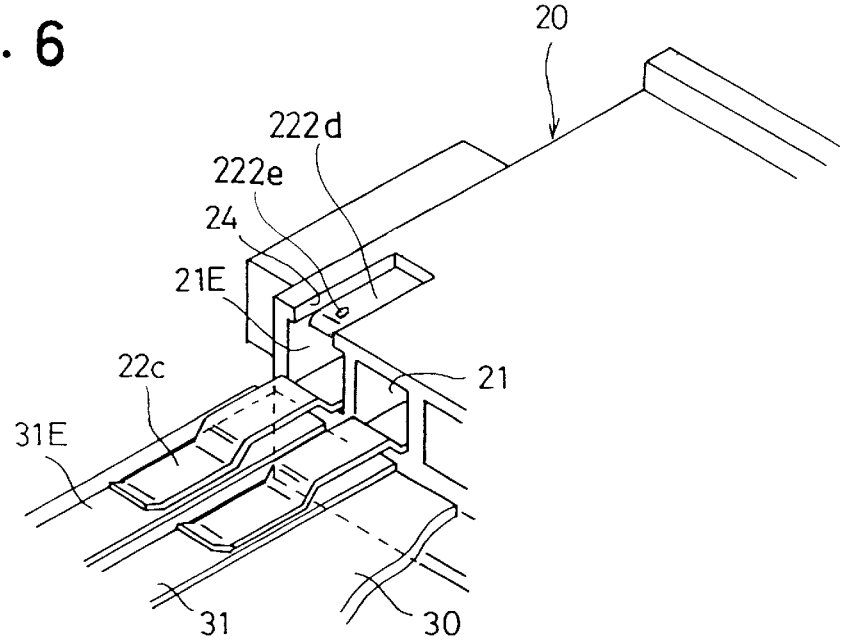
FIG. 6 is a perspective view of contacts housed in a contact compartment of a contact body according to the second embodiment of the present invention.

The contacts 222 are inserted in the ground contact compartments 21E in the same way as the insertion of the contacts 22. Consequently, the contacts 222 are held in place due to the engagement of the securing projections 22*b*. This state is shown in FIG. 6 in which the ground contacts pieces 222*d* are opposed to the cut-away portions 24 but do not project out of the cut-away portions 24.

Thereafter, a tool in the form of a plate is inserted in the ground contact compartment 21E to bend and raise the round contact piece 222*d* through the cut-away portion 21E. The ground contact piece 222*d* is bent beyond the elastic limit and projects out of the cut-away portion. Namely, the plastic deformation of the ground contact piece 222*d* occurs. Consequently, the ground contact piece 222*d* cannot be returned to the initial state after the external bending force is released. Namely, the ground contact pieces 222*d* have the same shape as the ground contact pieces 22*d* of the contacts 22 shown in FIG. 3.

The connector body 20 is mounted to the circuit board 30 and housed in the frame 10 in the same way as the first embodiment. The cover plate 40 which covers the upper open surface of the frame 10 comes into contact with the ground contact pieces 222*d* that project outward from the cut-away portions 24 of the connector body 20, the ground terminal 31E of the memory board 30 is electrically connected to the cover plate 40 through the contacts 222. Note that the ground contact pieces 222*d* are provided with projections 222*e* that can be brought into contact with the cover plate 40.

The ground contact piece 222*d* can be bent by a tool having a tapered tip like pliers by which the ground contact piece is held or by a rigid tool in the form of a plate which is inserted in the ground contact compartment 21E and bends the ground contact piece 222*d* about a fulcrum defined by the portion of the tool that abuts against the ground contact piece 222*d*.

The contacts 222 are inserted in the contact compartments 21 other than the ground contact compartments 21E. Since the contact compartments 21 have no cut-away portion, the ground contact pieces 222*d* are held on and along the inner wall surfaces of the corresponding contact compartments 21.

In the second embodiment, the ground contact pieces 222*d* of the contacts 222 only which are to be inserted in the ground contact compartments 21E are bent. Therefore, the pressing process of the contacts 222 can be simplified, thus resulting in a reduced manufacturing cost.

Figure 7:
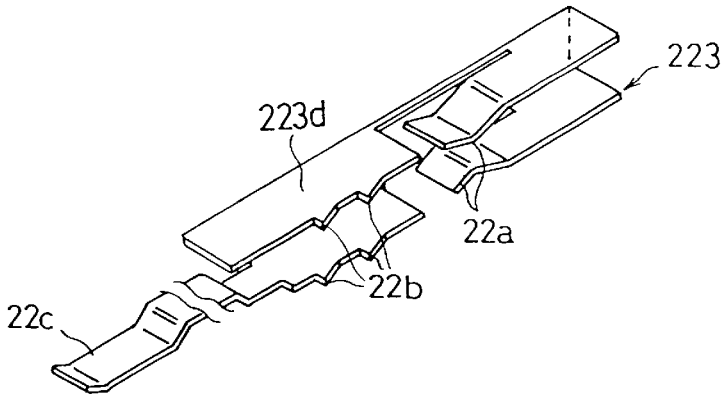
FIG. 7 is a perspective view of a contact body which can be applied to third and fourth embodiments of the present invention.
Figure 8A:
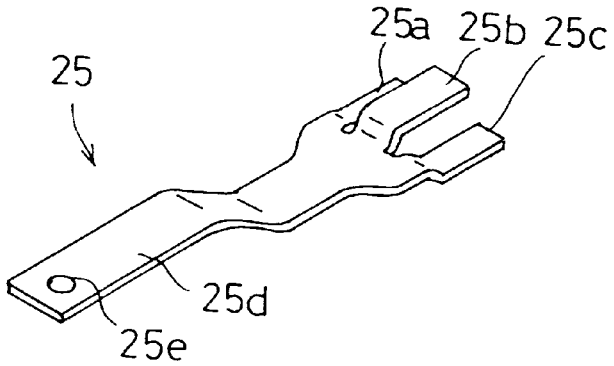
FIGS. 8A and 8B are perspective views of two examples of a ground terminal mounted to a contact body shown in FIG. 7.
Figure 8B:
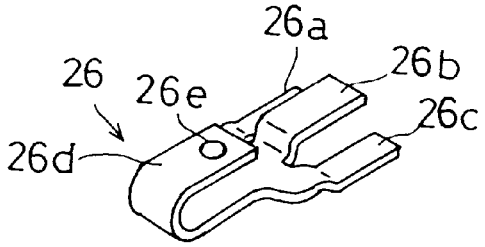

In the first and second embodiments mentioned above, the ground contact pieces are formed integral with the contact body. The discussion will be addressed below to third and fourth embodiments in which the ground contact pieces are made separately from the contact body. FIG. 7 shows a contact body which can be applied commonly to the third and fourth embodiments. FIGS. 8A and 8B show two examples (third and fourth embodiments) of a ground contact piece mounted to the contact shown in FIG. 7.

The contact body 223 is provided with a substantially planar holding piece 223*d* whose width is larger than that of the cut-away portion 24 since it is not necessary for the holding piece 223*d* to protrude from the cut-away portion 24 of the ground contact compartment 21E. The length of the holding piece 223*d* is such that it covers a part of the cut-away portions 24 when the contact is inserted in the ground contact compartment 21E.

The first ground contact terminal 25 is provided with three holding pieces 25*a*, 25*b* and 25*c* which hold therebetween the holding piece 223*d*. Likewise, the second ground contact terminal 26 is provided with three holding pieces 26*a*, 26*b* and 26*c* which hold therebetween the holding piece 223*d*. The difference between the first ground contact terminal 25 and the second ground contact terminal 26 resides in the ground contact piece. Namely, the ground contact piece 25*d* of the first ground contact terminal 25 is flat without being bent and the ground contact piece 26*d* of the second ground contact terminal 26 is bent in advance. The ground contact terminal 25 or 26 is made of a metal so as to have a higher resiliency than the contact body 223. Alternatively, it is possible to make the ground contact terminal 25 or 26 of the same material as the contact body 223. In the alternative, the ground contact terminal 25 or 26 is thicker than the contact body.

Figure 9:
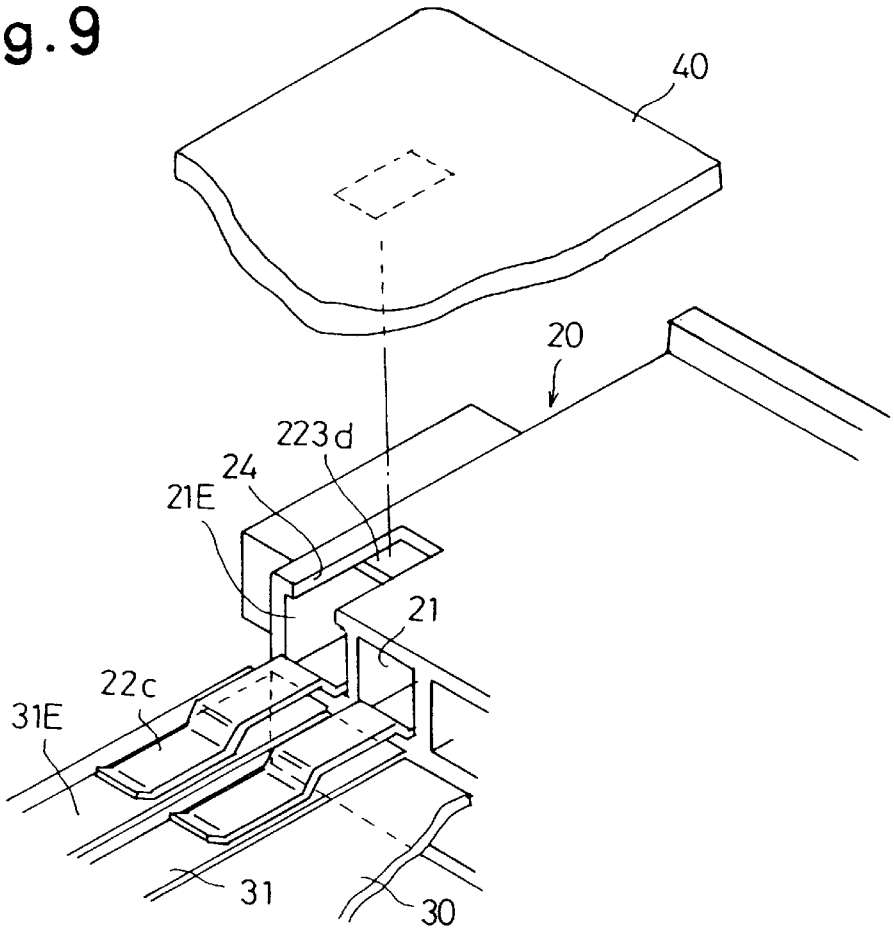
FIG. 9 is a perspective view of a contact body which is housed in a ground contact compartment in the third and fourth embodiments.
Figure 10:
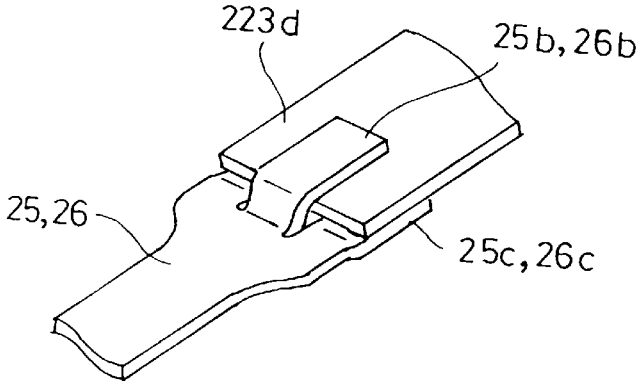
FIG. 10 is a perspective view of a connection between a contact and a ground terminal in the third and fourth embodiments.

The assembling operation of the contact body 223 and the ground contact terminal 25 or 26 will be discussed below with reference to FIGS. 9 and 10.

The contact body 223 is inserted in the corresponding ground contact compartment 21E, as in the case of the contacts 22 or 222. When the contact body 223 is received in the ground contact compartment 21E, the holding piece 223*d* covers a part of the cut-away portion 223*d* in the longitudinal direction thereof (FIG. 9). The contact bodies 223 are inserted in the remaining contact compartments 21. The holding pieces 223*d* of the contact bodies 223 extend on and along the inner wall surfaces of the contact compartments 21 without protruding outward therefrom.

Thereafter, the ground contact terminal 25 is mounted to the holding pieces 223*d*, so that the ground contact terminal 25 is held between the holding pieces 25*a*, 25*c* and the holding piece 25*b*. The holding piece 223*d* held between the holding pieces 25*a*, 25*c* and the holding piece 25*b* is shown in FIG. 10. As can be seen in FIG. 10, the end holding pieces 25*a* and 25*c* abut against the inner surface of the holding piece 223*d* and the intermediate holding piece 25*b* abuts against the outer surface of the holding piece 223*d*, so that the holding piece 223*d* can be firmly held between the end holding pieces 25*a*, 25*c* and the intermediate holding piece 25*d*.

Thereafter, the ground contact piece 25*d* of the ground contact terminal 25 is bent upward and outward through the cut-away portion 24. Once the plastic deformation of the ground contact piece 25*d* beyond the elastic limit takes place, the ground contact piece 25*d* permanently protrudes out of the cut-away portion 24. The ground contact piece 25*d* can be bent to the same extent as the ground contact piece 22*d* shown in FIGS. 1 through 3 or can be bent rearward at an angle of approximately 180 degrees, as shown in FIG. 8B. The bending of the ground contact piece 25*d* can be effected by bending upward the front end thereof. If a tool such as pliers which hold the ground contact piece 25*d* between opposed arms thereof is used, the bending operation can be precisely carried out without damaging other members of the contact.

Similarly to the ground contact terminal 25, the ground contact terminal 26 can be mounted to the holding piece 223*d* of the contact body 223 received in the ground contact compartment 21E. Since the ground contact piece 26*d* of the ground contact terminal 26 is bent in advance, the ground contact piece 26*d* projects out of the ground contact compartment 21E through the cut-away portion 21E without the bending operation after the insertion.

In the third and fourth embodiments, the assembling operation subsequent to the insertion of the contact bodies 223 into the contact compartments 21E and 21, followed by the mounting and bending of the ground contact terminal 25 to the holding piece 223*d* or the mounting of the ground contact terminal 26 to the holding piece 223*d*, is carried out in the same way as the first and second embodiments.

In the third and fourth embodiments, since the contact body 223 is made of a piece separate from the ground contact terminal 25 or 26, there is more freedom in selection of the material of which the ground contact terminal 25 or 26 can be made. Consequently, it is possible to make the ground contact terminal 25 or 26 of a more resilient material than the contact body or make the ground contact terminal of the same material as the contact body wherein the ground contact terminal 25 or 26 is thicker than the contact body so as to provide a higher resiliency. Consequently, the reliable and firm contact of the ground contact terminal 25 or 26 with the cover plate 40 can be ensured.

Although, in the third and fourth embodiments, the ground contact terminal 25 or 26 has a clip structure in which the holding piece 223*d* of the contact body 223 is held by three holding pieces, the shape and the number of the holding pieces are not limited to those in the illustrated embodiments.

In the above-mentioned embodiments, the contacts 22 inserted in the ground contact compartments 21E and the contacts 22 inserted in the contact compartments 21 are identical and, hence the manufacturing cost of the components can be reduced due to the identical shape. Nevertheless, in the present invention, the contacts which are to be inserted in the ground contact compartments 21E may be different in shape from the contacts which are to be inserted in the remaining contact compartments. Although the illustrated embodiments are applied to a memory card whose upper and lower surfaces are connected to the contacts received in the two rows of upper and lower contact compartments 21, the present invention can be applied to a memory card of which only one surface is used.

As can be understood from the above discussion, according to the present invention, in a manufacturing method of a connector having a ground terminal for a memory card, an electrical connection between the metal cover plate and the ground terminal of the memory board can be easily carried out.

Moreover, according to the present invention, since the ground contact pieces of the contacts only which are received in the contact compartments having the cut-away portions are bent, it is not necessary to bend the ground contact pieces of the other contacts upon manufacturing. Thus, not only can the assembling operation be simplified, but also the manufacturing cost can be reduced.

Furthermore, if the contact bodies which are adapted to connect the terminals of the memory board and the external insertion pins are made of a piece separate from the ground contact pieces connected to the cover plate, it is possible to provide a high resiliency or a wide range of elastic deformation to the ground contact pieces, thus a stable and reliable contact therebetween can be attained.

According to the present invention, since all the contacts or contact bodies can be identical in shape, they can be easily produced using same pressing die. Consequently, not only can the manufacturing cost be reduced but also the maintenance cost of the components can be curtailed.

What is claimed is:

1. A method for manufacturing an electrical connector for a memory card and having contacts with a ground terminal, said connector comprising: a synthetic resin frame; a memory board housed in said frame, a number of metal contacts for connecting conductor patterns of said memory board with external pins; a connector body formed from synthetic resin having a number of contact compartments in which said contacts are respectively received; a metal cover plate which covers an opening of said frame in which said memory board and said connector body are housed, and a cut-away portion which is formed on at least one but not all of said contact compartments of said connector body and which is opposed to said cover plate, wherein said method comprises:

forming, on each of the contacts, a pattern contact piece which comes into contact with one of the conductor patterns of said memory board, a pin contact piece which comes into contact with the external pin inserted from the outside, and a ground contact piece which projects from said cut-away portion to come into contact with said metal cover plate if the contact is inserted into said at least one contact compartment; and inserting the contacts into their respective contact compartments before the connector body is placed in the frame.

2. A method for manufacturing an electrical connector for a memory card according to claim 1, wherein each of said ground contact pieces is provided with a projection which comes into contact with the cover plate if the associated contact is inserted into said at least one contact compartment.

3. A method for manufacturing an electrical connector for a memory card and having contacts with a ground terminal, said connector comprising: a synthetic resin frame; a memory board housed in a frame, a number of metal contacts for connecting conductor patterns of said memory board and external pins; a connector body formed from synthetic resin having a number of contact compartments in which the contacts are respectively received; a metal cover plate which covers an opening of the frame in which said memory board and said connector body are housed; and a cut-away portion which is formed on at least one but not all of the contact compartments of the connector body an which is opposed to the cover plate, wherein said method comprises:

forming, on each of said contacts, a pattern contact piece which comes into contact with one of the conductor patterns of said memory board, a pin contact piece which comes into contact with the external pin inserted from the outside, and a ground contact piece;

inserting, prior to the arrangement of said connector body into the frame, the contacts into their respective contact compartment; and bending the ground contact piece of each contact which is inserted in a contact compartment having a cut-away portion so as to project outward from the cut-away portion, so that the ground contact piece can be brought into contact with the cover plate.

4. A method for manufacturing an electrical connector for a memory card according to claim 3, wherein each of said ground contact pieces is provided with a projection which comes into contact with the cover plate if the associated contact is inserted into said at least one contact compartment.

5. A method for manufacturing an electrical connector for a memory card and having contacts with a ground terminal, said method comprising: a synthetic resin frame; a memory board housed in said frame, metal contacts for connecting conductor patterns of said memory board with external pins; a connector body formed from synthetic resin having a number of contact compartments in which said contacts are received; a metal cover plate which covers an opening of said frame in which said memory board and said connector body are housed, and at least one but not all of said contact compartments having a cut-away portion which is opposed to said cover plate, wherein said method comprises:

forming, on each of the contacts, a pattern contact piece which comes into contact with one of the conductor patterns of said memory board, a pin contact piece which comes into contact with the external pin inserted from the outside, and a ground contact piece which comes into registration with the cut-away portion of said at least one of said contact compartments if the contact is inserted into said at least one contact compartment;

inserting the contacts into the corresponding contact compartments before the connector body is placed in the frame; and then placing said connector body in said frame and covering said frame with said metal plate so that said metal plate comes into contact with said ground contact piece of the contact received in said at least one contact compartment.

6. A method for manufacturing an electrical connector for a memory card according to claim 5, wherein said contacts are so formed prior to insertion of the contacts into the corresponding contact compartments that upon insertion of a contact into said at least one of said contact compartments, the ground contact piece will project outwardly from the cut-away portion of said at least one contact compartment.

7. A method for manufacturing an electrical connector for a memory card according to claim 5, wherein said ground contact piece when a contact is inserted into said at least one contact compartment does not initially project out of the cut-away portion of said at least one contact compartment; and then, after a contact is inserted into said at least one contact compartment, bending the ground contact piece of that contact so that said ground contact piece does project out of said cut-away portion.

8. A method for manufacturing an electrical connector for a memory card according to claim 5 wherein, said ground contact piece when a contact is inserted into said at least one contact compartment does not initially project out of the cut-away portion of said at least one contact compartment: and then, after a contact is inserted into said at least one contact compartment, attaching to the ground contact piece of that contact a ground contact terminal which projects out of the cut-away portion.

* * * * *